US006861807B2

(12) United States Patent
Born et al.

(10) Patent No.: US 6,861,807 B2
(45) Date of Patent: Mar. 1, 2005

(54) CONTROL OF LEACHABLE MERCURY IN MERCURY VAPOR DISCHARGE LAMPS

(75) Inventors: Matthias Born, Geldern (DE); Rüdiger Jost, Roetgen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/276,786

(22) PCT Filed: Mar. 21, 2002

(86) PCT No.: PCT/IB02/00944

§ 371 (c)(1),
(2), (4) Date: Nov. 19, 2002

(87) PCT Pub. No.: WO02/078051

PCT Pub. Date: Oct. 3, 2002

(65) Prior Publication Data

US 2003/0178942 A1 Sep. 25, 2003

(30) Foreign Application Priority Data

Mar. 23, 2001 (DE) ..... 101 14 680

(51) Int. Cl.[7] ..... H01J 17/20; H01J 61/12

(52) U.S. Cl. ..... 313/637; 313/638; 313/640; 313/643; 313/567; 313/568; 313/576

(58) Field of Search ..... 313/567, 568, 313/576, 637, 638, 640, 643

(56) References Cited

FOREIGN PATENT DOCUMENTS

| | | | | |
|---|---|---|---|---|
| DE | 33418462 | | 11/1983 | ..... H01J/61/88 |
| EP | 0056872 A1 | | 8/1982 | ..... E02D/1/02 |
| EP | 0056872 B1 | | 3/1985 | ..... E02D/1/02 |
| EP | 0883160 A1 | | 12/1998 | ..... H01J/61/12 |
| EP | 0 883 160 A1 | * | 12/1998 | ..... H01J/61/12 |

* cited by examiner

*Primary Examiner*—Nimeshkumar D. Patel
*Assistant Examiner*—Sharlene Leurig

(57) ABSTRACT

The invention relates to a high-pressure gas discharge lamp, particularly a motorcar lamp, comprising a bulb including at least two neck portions and a vacuum-tight discharge vessel of quartz glass, at least two electrodes projecting into the discharge vessel, and a filling in the discharge vessel which, in the operating state, is in a discharge state. Such lamps are used, in particular, in headlights of motorcars. In order to ensure that the arc of the high-pressure gas discharge lamp generates a higher luminescence in a small area, and the lamp can be used as a light source in motorcar headlights, the discharge vessel of the high-pressure gas discharge lamp in accordance with the invention encloses a discharge space having a width B below 4 mm and a length C below 8 mm, and the filling comprises NaI, $ScI_3$, Xe, $ZnI_3$ and is free of Hg. Surprisingly it has been found that the use $ZnI_2$ in the filling causes the arc to generate a higher luminescence in the area of the arc axis per dimension of the arc. In the case of motorcar headlights, forming the desired light beam on the street requires the light source to be as punctiform as possible, i.e. the highest possible luminescence is generated in a small area. This enables the design of the reflector to be improved and the arc to be more accurately projected on the street. This applies also to headlights comprising an optical projection system instead of a reflector.

11 Claims, 1 Drawing Sheet

CONTROL OF LEACHABLE MERCURY IN MERCURY VAPOR DISCHARGE LAMPS

Figure 1:
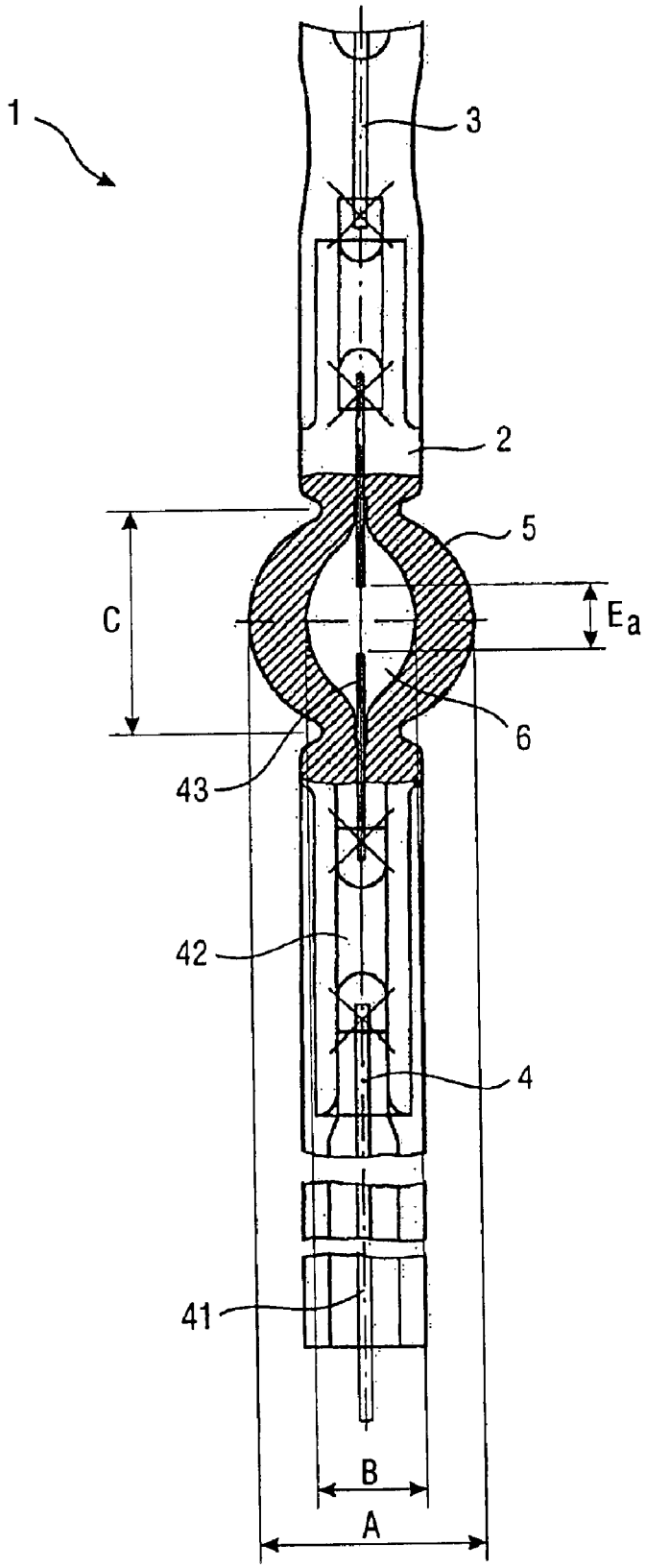

The invention relates to a high-pressure gas discharge lamp, particularly a motorcar lamp, comprising a bulb including at least two neck portions and a vacuum-tight discharge vessel of quartz glass, at least two electrodes projecting into the discharge vessel, and a filling in the discharge vessel which, in the operating state, is in a discharge state. Such lamps are used, in particular, in headlights of motorcars.

A high-pressure discharge lamp of this type is disclosed, for example, in DE 33 41 846, which is laid open to public inspection. The gas discharge lamp described in said document has an arc which, also in a horizontal burning position, extends in an at least substantially straight line, and the lamp has a high light efficiency, so that said lamp can suitably be used in motorcar headlights. Said lamp comprises a tubular quartz bulb in which an electrode is arranged near each end of said bulb. The electrodes used may be a thoriated tungsten wire or a tungsten wire that is helically wound on a wire. Two current supply conductors extend from the electrodes, through a vacuum-tight seal of the bulb, to the exterior. Said current supply conductors are each composed of, for example, a metal foil of tungsten or molybdenum and a wire, preferably of molybdenum. The vacuum-tight seal is formed, for example, by a pinch. The bulb has an internal diameter D, centrally between the electrodes, of 1–3 mm. The distance between the electrode tips is 3.5–6 mm, and the length L, i.e. the amount that the electrodes project into the lamp bulb, is 0.5–1.5 mm. The lamp contains an ionizing filling of an inert gas, mercury and metal iodide, the amount of mercury being dependent upon the diameter D of the bulb of the lamp, the distance d between the tips of the electrodes, and the length L. The lamp may comprise a base, so that it can be exchangeably arranged in a headlight comprising a reflector and a front glass. The lamp may be embodied so as to comprise, or not comprise, an outer bulb. A high-pressure discharge lamp for motorcars is known also from European patent EP 0 562 872. Said document discloses a discharge light source that combines a high brightness with sufficient convective stability of the arc of the gas discharge. The light source of the arc discharge comprises a discharge tube wherein an arc chamber is formed, which contains a gas filling that can be brought into a discharge state by supplying energy. At least two electrodes project into the arc chamber and have an arc distance ranging from 2 to 3.5 mm. The amount of mercury contained in the arc chamber and different dimensions of the discharge tube are chosen to be such that a compromise between the three dependencies, i.e. the operating voltage, which determines the lamp efficiency, the convective stability and the structural integrity of the discharge lamp, is obtained.

If the lamp is used in motorcars, the position of the discharge are in the discharge vessel and the dimension of the arc are critical because the arc forms the light source to be projected by means of a reflector. To form the desired light beam on the street, it is necessary for the light source to be as punctiform as possible, so as to enable the highest possible luminescence to be generated in a small area. This enables the design of the reflector to be improved and the arc to be more accurately projected on the street. This applies also to headlights comprising an optical projection system instead of a reflector. It is also required for the discharge arc constituting the punctiform light source to stay in position as accurately as possible. These requirements are based, in particular, on statutory regulations. Known high-pressure gas discharge lamps for motorcars additionally have the disadvantage that toxic mercury is used in the filling for the gas discharge.

It is an object of the invention to provide a high-pressure gas discharge lamp, such that the arc generates a higher luminescence in a small area, and the high-pressure gas discharge lamp can be used as a light source in motorcar headlights.

This object is achieved by a high-pressure gas discharge lamp, in particular a motorcar lamp, wherein the discharge vessel encloses a discharge space having a width B below 4 mm and a length C below 8 mm, and the filling comprises NaI, $ScI_3$, Xe, $ZnI_2$, and is free of Hg. Surprisingly it has been found that the use of $ZnI_2$ in the filling causes the arc to generate a higher luminescence in the area of the arc axis per dimension of the arc. In the operating state of the lamp, the filling is in the discharge state, so that a larger amount of free I is available in the discharge vessel, which leads to a constriction of the arc and to a higher luminescence in the area of the arc axis. Customary motorcar lamps generate approximately 100 Mcd/$m^2$, whereas a lamp in accordance with the invention generates up to approximately 150 Mcd/$m^2$. The filling used in the lamp in accordance with the invention does not require mercury (Hg) for the light-generating gas discharge. Consequently, also from an environmental point of view, such a lamp is very advantageous as the toxic and environmentally harmful Hg requires expensive treatments during the manufacture as woll as the disposal of the lamps. The bulb of the lamp is preferably elongated and comprises two cylindrical sections as the neck portions and, arranged therebetween, a generally substantially ellipsoid-shaped discharge vessel having a substantially cylindrical portion in the center of the discharge vessel. In this case, the electrodes originating in a part outside the lamp extend, from both sides, through the cylindrical sections into the discharge vessel, where they are situated at a distance of approximately 4 mm from each other, For ease of manufacture the discharge vessel may be ellipsoidal or spherical in shape which, however is not absolutely necessary for a lamp in accordance with the invention. Attention should rather be paid to the geometrical requirements to be met so as to enable said lamp to be employed in motorcars. Said requirements are statutory regulations or requirements imposed by the automotive industry, which enable the lamp in accordance with the invention and the high-pressure gas discharge lamps currently used in motorcar headlights to be interchangeable. Such requirements particularly relate to the dimensions of the lamp and the location where light is generated (i.e. the location of the arc), the electrical data (such as, for example, power and voltage) of the lamp which must be supplied by an electrical ballast, as well as the efficiency and the color rendering index $R_a$ of the lamp.

The generation of light is brought about by the gas discharge of the filling composed of $ZnI_2$, Xe and the mixture of the metal halides NaI and $ScI_3$ in the discharge chamber. The use of $ZnI_2$ is necessary for adjusting a sufficiently high arc-drop voltage. The metal halide mixture (NaI and $ScI_3$) contributes decisively to the generation of light, while, the inert gas Xe enhances the ignition and the start of the discharge process. The metal halide mixture also increases the service life of the lamp binding impurifying gas components (dirt getter). In addition, the mixture of the halides NaI and $ScI_3$ influences the color point of the light generated.

Advantageous modifications of the high-pressure gas discharge lamp in accordance with the invention are indicated in the other claims and in the example described herein.

These and other aspects of the high-pressure gas discharge lamp in accordance with the invention will be apparent from and elucidated with reference to the embodiment(s) described hereinafter.

In the drawings:

FIG. 1 shows a high-pressure gas discharge lamp for use as a motorcar headlight in accordance with the invention.

FIG. 1 shows a high-pressure gas discharge lamp 1 comprising a tubular bulb 2 of quartz glass and two opposing electrodes 3 and 4. The length of the bulb 2 ranges from 50 to 110 mm. A discharge vessel 5 is arranged approximately in the center of the bulb 2. The discharge vessel 5 is sealed in a vacuum-tight manner by two pinches in the bulb 2.

The electrode 4 is composed of an outer electrode 41 for external contact, a molybdenum foil 42 and an inner electrode 43. The second electrode 3 is similarly constructed. The molybdenum foil 42 interconnects the outer electrode 41 and the inner electrode 43 situated in the area of a pinch of the bulb 2. The inner electrode 43 extends into the discharge vessel 5 where it is situated at a distance $E_a$ of approximately 4 mm from the other inner electrode. Such lamps are used as so-termed D2 lamps in headlights of motorcars.

The discharge vessel 5 encloses a discharge space 6 having a substantially cylindrical central portion whose width, or diameter, referenced B, is 2.7 mm. The discharge vessel 5 has an external width, referenced A, of approximately 6.2 mm and a length, referenced C, of 7.4 mm. The discharge space 6 has a volume of approximately 0.027 $cm^3$. The discharge space 6 contains a filling that is composed of 100 $\mu$m $ZnI_3$ at a cold filling pressure of 6 bar (i.e. at room temperature) as well as a metal halide mixture NaI and $ScI_3$. $ZnI_2$ is generally available in pressed form, the quantity fed in is subject to minor variations only. The filling comprises in total approximately 300 $\mu$g of the halide mixture in a ratio of approximately 70:30, so that the filling comprises approximately 210 $\mu$g NaI and 90 $\mu$g $ScI_3$. At the above-mentioned volume of the discharge space 6, this corresponds approximately to 50 $\mu$mol/$cm^3$ NaI and 8 $\mu$mol/$cm^3$ $ScI_3$ (corresponding to a molar ratio of approximately 6:1) as well as approximately 11 $\mu$mol/$cm^3$ $ZnI_2$. The quantities of NaI and $ScI_3$ indicated above may vary as a function of the relevant method of manufacture, without the light-technical properties of the lamp 1 in accordance with the invention being adversely affected. The metal halide mixture in the filling limits the possible average wall temperature of the discharge vessel 5 to approximately 1270 K, since, at higher temperatures, the mixture would chemically react with the quartz used as a wall material.

A quantity of $ZnI_2$ of 100 $\mu$g by weight corresponds to a partial pressure of 2.4 bar in the discharge vessel. The maximum $ZnI_2$ pressure is limited by the arc constriction resulting from the high electron affinity of the iodine atoms. During horizontal lamp operation, as, for example, in a motorcar headlight, the arc constriction leads to arc deflection due to gravitation. Said arc deflection causes the arc to be poorly projected by the reflector of the headlight as said arc is situated outside the axis of the reflector. This also applies to headlights wherein projection systems ate employed. Said arc deflection also leads to a substantial difference between the highest and the lowest temperature in the discharge vessel 5, which adversely affects the light-technical properties of the lamp 1, such as the efficiency and the color temperature. It has been found that these drawbacks are negligibly small up to a $ZnI_2$ partial pressure of 4 bar. Therefore, the lamp 1 preferably comprises a quantity of $ZnI_2$ in the range from 50–200 $\mu$g, corresponding, at the above-mentioned volume of the discharge space 6, to approximately 5–20 $\mu$mol/$cm^3$ or a partial pressure in the range from approximately 1.2–3.6 bar. As a result of the lower partial pressure of the buffer gas $ZnI_2$ in comparison with the Hg partial pressure of approximately 25 bar in the known lamps, the lamp 1 in accordance with the invention is operated at an operating voltage $U_B$=39–45 V. Due to the reduced operating voltage, the lamp current must be increased to approximately 0.8–1 A.

In the example, the lamp 1 is supplied with an operating voltage of 42 V at a power of 39 W, resulting in a lamp current of approximately 0.9 A. The clearly higher lamp current can be obtained by means of the above-described electrodes 3, 4. The inner electrode 43 consists of a tungsten wire. The tungsten pin 43 has a diameter of approximately 0.25 mm in the discharge vessel S, which diameter can be increased to approximately 0.4 mm to improve the electrical conductibility. The use of a quantity of 100 $\mu$g $ZnI_2$ leads to a slight constriction of the arc and an increase of the luminescence to approximately 150 Mcd/m2. The lamp 1 has the following light-technical values: an efficiency of approximately 90 lm/W, a color rendering index $R_a$=68, a color temperature of the light generated of approximately $T_c$=4300 K and an average wall temperature of the discharge vessel 5 of approximately 1270 K. Thus, the lamp 1 fulfills the necessary requirements for use as a light source in motorcar headlights and can be used as suitable for known D2 lamps.

What is claimed is:

1. A high-pressure gas discharge lamp comprising a bulb including at least two neck portions and a vacuum-tight discharge vessel of quartz glass, at least two electrodes projecting into the discharge vessel, and a filling in the discharge vessel which, in the operating state, is in a discharge state, wherein the discharge vessel encloses a discharge space having a width B below 4 mm and a length C below 8 mm, and the filling consists of 200–230 $\mu$g NaI, 80–100 $\mu$g $ScI_3$, Xe at a filling pressure of approximately 6 bar at room temperature, and 50 $\mu$g to 200 $\mu$g $ZnI_2$.

2. A high-pressure gas discharge lamp comprising a bulb including at least two neck portions and a vacuum-tight discharge vessel of quartz glass, at least two electrodes projecting into the discharge vessel, and a filling in the discharge vessel which, in the operating state, is in a discharge state, wherein the discharge vessel encloses a discharge space having a width B below 4 mm and a length C below 8 mm, and the filling consists of 44–55 $\mu$mol/$cm^3$ NaI, 7–9 $\mu$mol/$cm^3$ $ScI_3$, Xe at a filling pressure of approximately 6 bar at room temperature, and 5 to 20 $\mu$mol/$cm^3$ $ZnI_2$.

3. A high-pressure gas discharge lamp comprising a bulb including at least two neck portions and a vacuum-tight discharge vessel of quartz glass, at least two electrodes projecting into the discharge vessel, and a filling in the discharge vessel which, in the operating state, is in a discharge state, wherein the discharge vessel encloses a discharge space having a width B below 4 mm and a length C below 8 mm, and the filling comprises 45–55 $\mu$mol/cm$^3$ NaI, 7–9 $\mu$mol/cm$^3$ $ScI_3$, Xe at a filling pressure of approximately 6 bar at room temperature, and 5 to 20 $\mu$mol/cm$^3$ $ZnIi_2$, and is free of Hg.

4. A lamp as claimed in claim 3, wherein the electrodes consist of tungsten wire.

5. A lamp as claimed in claim 3, wherein the discharge space has a volume in the range from 0.025 to 0.03 cm$^3$.

6. A lamp as claimed in claim 3, wherein, in the operating state, an operating voltage $U_B$ below 60 V is applied to the lamp.

7. A lamp as claimed in claim 3, wherein, in the operating state, an operating voltage $U_B$ in the range from 39 to 45 V is applied to the lamp.

8. A lamp as claimed in claim 3, wherein, in the operating state, the current consumption of the lamp ranges from 0.8 to 1.0 A.

9. A lamp as claimed in claim 3, wherein, in the operating state, the power consumption of the lamp ranges from 35 to 40 W.

10. A lamp as claimed in claim 3, wherein the lamp has a luminous efficacy of at least 85 lm/W and a color rendering index $R_a$ in the range from 62 to 72.

11. A lamp as claimed in claim 3, wherein the filling comprises 100 $\mu$g $ZnI_2$.

* * * * *